United States Patent [19]

Leemhuis

[11] Patent Number: 5,005,820

[45] Date of Patent: Apr. 9, 1991

[54] PAPER TRAY WITH LEAF SPRING

[75] Inventor: Michael C. Leemhuis, Nicholasville, Ky.

[73] Assignee: International Business Machines Corporation, Armonk, N.Y.

[21] Appl. No.: 370,923

[22] Filed: Jun. 23, 1989

[51] Int. Cl.[5] ..... B65H 1/08

[52] U.S. Cl. ..... 271/127; 271/160

[58] Field of Search ..... 271/126, 127, 160, 171, 271/147, 145

[56] References Cited

U.S. PATENT DOCUMENTS

| | | | |
|---|---|---|---|
| 3,635,468 | 1/1972 | Suzuki | 271/127 X |
| 3,758,105 | 9/1973 | Okamoto | 271/127 X |
| 4,337,935 | 7/1982 | Sawada et al. | 271/9 |
| 4,350,328 | 9/1982 | Katakura et al. | 271/22 |
| 4,726,698 | 2/1988 | Weiss et al. | 271/160 X |
| 4,765,605 | 8/1988 | Abbott | 271/147 |

FOREIGN PATENT DOCUMENTS

| | | | |
|---|---|---|---|
| 330276 | 8/1989 | European Pat. Off. | 271/160 |
| 0037937 | 4/1981 | Japan | 271/127 |
| 0113631 | 9/1981 | Japan | 271/160 |
| 0145041 | 11/1981 | Japan | 271/160 |
| 0072526 | 5/1982 | Japan | 271/160 |
| 0057838 | 4/1984 | Japan | 271/160 |
| 0252537 | 12/1985 | Japan | 271/127 |
| 0211239 | 9/1986 | Japan | 271/160 |

OTHER PUBLICATIONS

Bensen, "Spring Ramp Paper Tray with Constant Lead Edge Height", 12-1980, Xerox Disclosure Journal, vol. 5, No. 6, p. 593.

*Primary Examiner*—Robert P. Olszewski
*Assistant Examiner*—Boris Milef
*Attorney, Agent, or Firm*—Charles E. Rohrer

[57] ABSTRACT

A paper bin assembly including a movable bottom tray for holding a stack of print receiving material, such as paper. The assembly is designed for insertion into a machine using sheets of paper, such as a copier or printer. A leaf spring is used to move the tray upwardly to keep the top sheet of the stack in position for being fed from the stack by a paper feeding mechanism. As sheets are fed from the stack, the spring continues to provide the top sheet in position, and continues to provide a correct normal force between the paper feeding mechanism and the top sheet. This is accomplished over a wide range of paper size and density by affording an adjustment mechanism to vary the spring rate. The adjustment mechanism involves a movable spring support member which moves in one direction relative to a fixed spring support member, and by providing an offset in a second dimension between the two spring support members.

4 Claims, 7 Drawing Sheets

PAPER TRAY WITH LEAF SPRING

This invention relates to paper handling devices and, more particularly, to paper bins for use in feeding sheets of paper serially into machines, such as a copier or printer.

BACKGROUND OF THE INVENTION

In machines, such as copiers or printers, paper or other print-receiving material is held in a paper bin and fed, one sheet at a time, into the machine. Frequently, paper bins are used which hold a large amount of paper; for example, a stack of 500 sheets or more. To reload a bin, a paper tray is usually slideably removed from operating engagement within the machine, a stack of paper is placed onto the tray and the tray is returned to operating position within the machine. Normally, the stack of paper is placed on a tray which is mounted on powered elevator mechanisms which move the loaded tray upwardly so that the top sheet on the tray contacts paper feed rolls positioned above the paper stack. Arrangements of this kind, while suitable for more expensive high-volume machines, are not suitable for low cost slower speed desk-top machines. Usually, the low cost machines contain paper cassettes which may hold, for example, a stack of 25 or 50 sheets. In arrangements of this kind, the stack of paper is placed in the cassette on a tray which is spring biased upwardly so that the top sheet on the tray contacts paper feed rolls positioned above the cassette. In that manner, expensive powered elevator arrangements are avoided.

It is an object of this invention to provide a spring-biased tray capable of holding a large amount of paper (for example, 500 sheets or more) so that a paper bin of considerable size can be utilized on a low cost copier or printer.

It is another object of this invention to provide a spring mechanism for use with a paper tray which is easily adjustable for different weight and sizes of paper.

It is still another object of this invention to provide a paper tray with a leaf spring having an adjustable spring rate so that the contact force between the paper and the feed roll is maintained fairly constant as the number of sheets in the tray decreases from a large number, such as 500, to 0.

It is another object of this invention to provide a paper tray with a lift spring rate which is adjustable to provide a proper feed roll contact force regardless of the weight and size of the paper.

The objects of the instant invention have not been met in the prior art. U.S. Pat. No. 4,337,935 shows a typical paper cassette in which a coil spring lifts a paper tray so that contact may be made with a feed roll. Such a device is useful in paper cassettes, but is not capable of handling a large number of sheets.

U.S. Pat. No. 4,350,328 shows a sheet-feeding apparatus in which a pivotally disposed tray is urged upwardly by an arm which is pivotally mounted and biased by a coil spring.

U.S Pat. No. 4,765,604 shows a paper tray upwardly biased by an arm which is pulled upwardly by a coil spring.

SUMMARY OF THE INVENTION

This invention relates to a sheet-holding mechanism in which a movable tray is located within a paper holding bin, and which is biased upwardly by a leaf spring mechanism whose spring rate is adjustable. In that manner, the top sheet of a stack of paper situated on the paper tray is brought into position for being fed by a feed roll into a processing machine. Adjustment of the leaf spring rate enables the mechanism to maintain correct normal force between the feed roll and the top sheet of paper over a wide range of paper weight and throughout the feeding operation regardless of the number of sheets remaining in the tray. Adjustment is accomplished by providing a movable support member for the leaf spring such that the spring rate is changed as the movable support member is moved. As the spring rate is reduced, the leaf spring is enabled to provide an increased deflection. In that manner, the leaf spring force is varied linearly with relatively small angles of deflection. The mechanism is provided with an offset between the height of the movable support member and a fixed leaf spring support member so that the leaf spring will exhibit a constant no-paper-load force on the paper tray regardless of the position of the movable support member. In that manner, an adjustment range is provided to accommodate a range of sizes and densities of paper so that a proper normal force between the top sheet and the feed roll can be maintained regardless of the number of sheets in the bin, and regardless of the density and size of the paper in the bin within the range provided.

BRIEF DESCRIPTION OF THE DRAWINGS

The above-mentioned objects and other features and objects of this invention, and the manner of attaining them, will become more apparent, and the invention itself will best be understood by reference to the following description of embodiments of the invention taken in conjunction with the accompanying drawings, the description of which follows.

DETAILED DESCRIPTION OF THE PREFERRED EMBODIMENT

Figure 1:
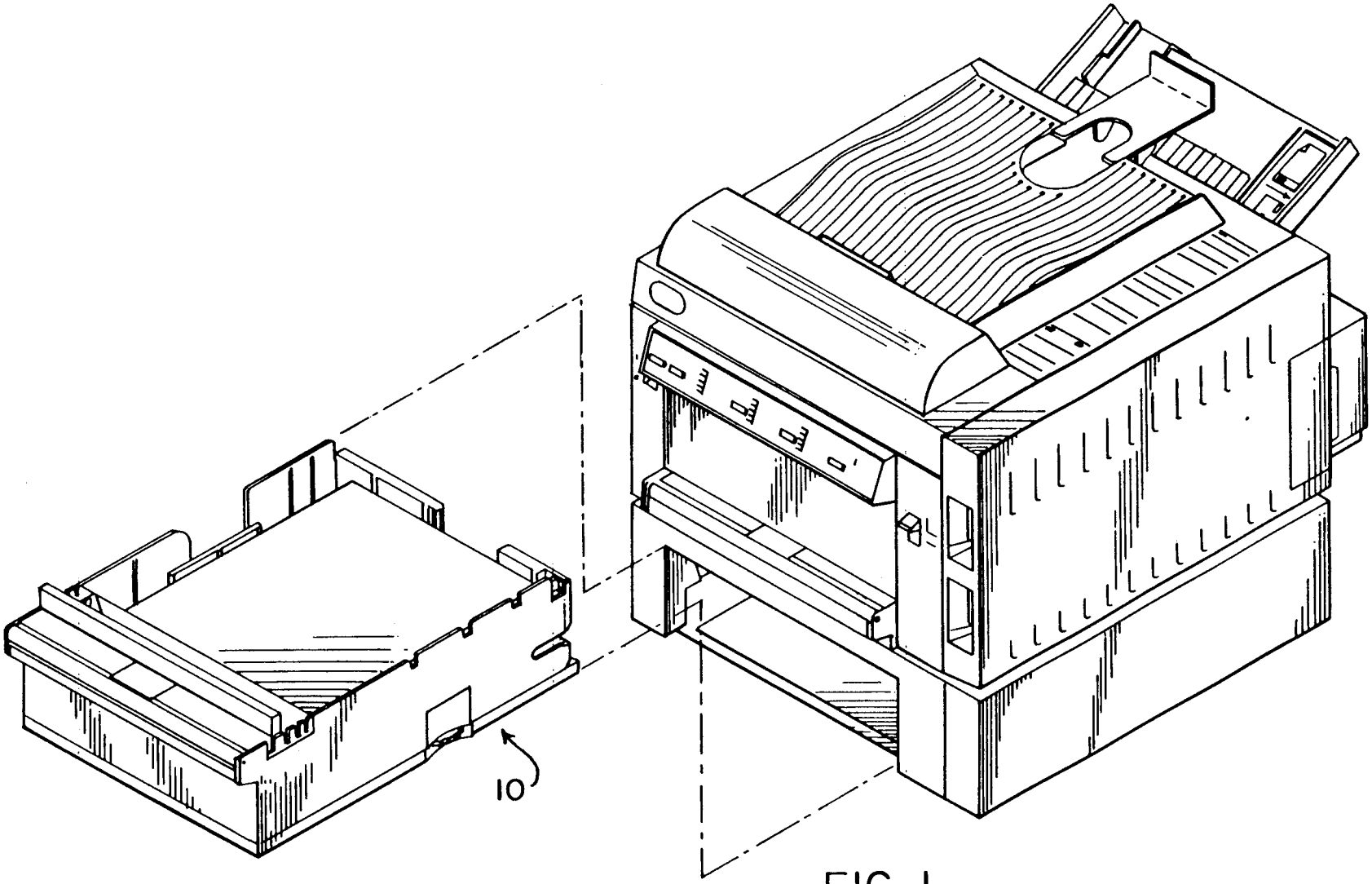
FIG. 1 shows a copier or printer machine with a paper bin holding at least 500 sheets.

FIG. 1 shows a printing or copier machine of the type in which the instant invention can be employed. A paper bin assembly 10 is shown out of the machine so that sheets of print-receiving material, usually paper, can be loaded into the assembly.

Figure 2:
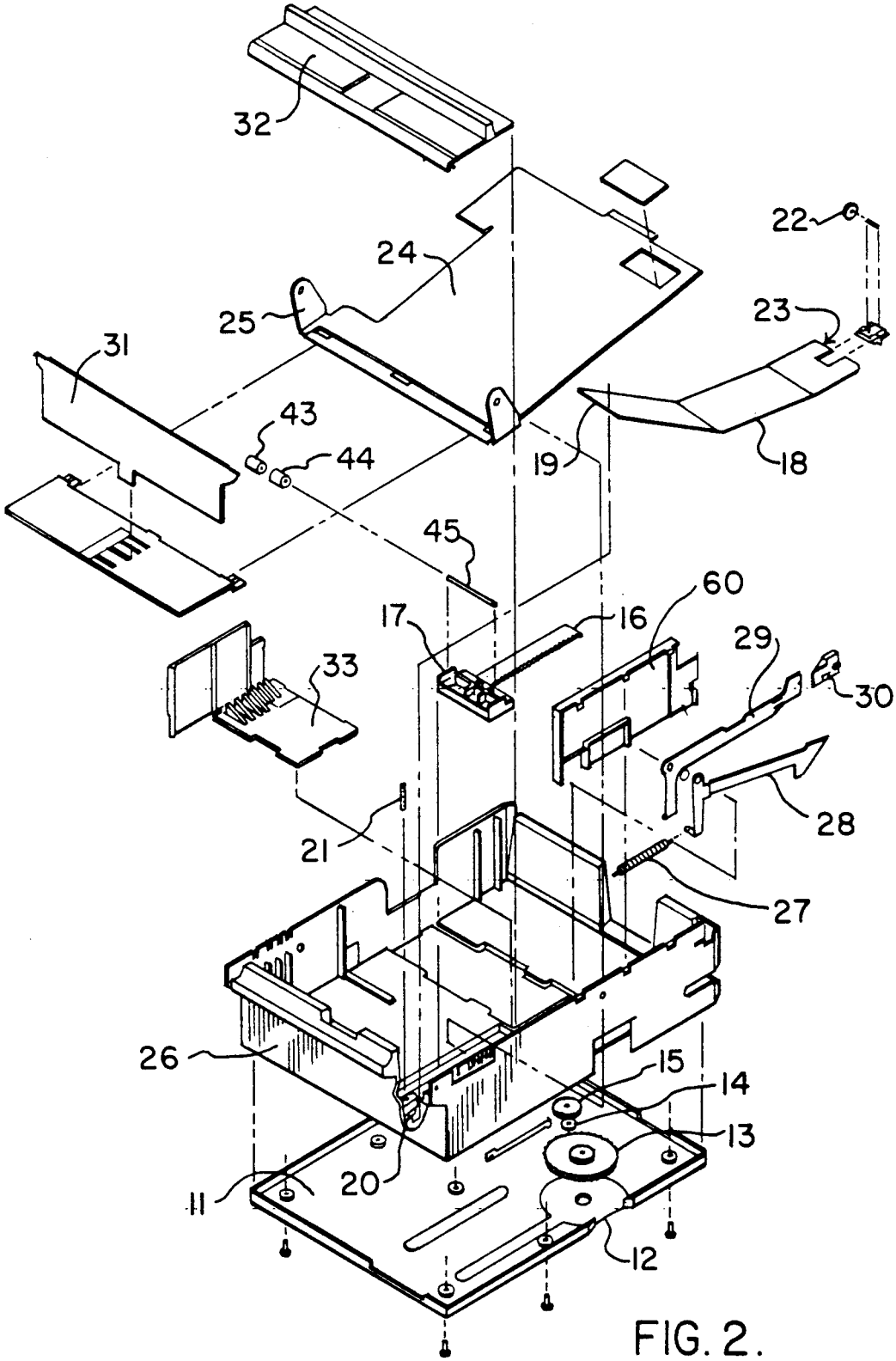
FIG. 2 shows an exploded view of the parts which comprise the paper bin of the instant invention for use in the machine of FIG. 1.

FIG. 2 is an exploded view of paper bin assembly 10 showing the parts thereof. A bottom cover 11 contains a notch 12 providing access for a machine operator to the side of a thumb wheel 13. The thumb wheel 13 drives a thumb wheel gear 14 which contacts a second gear 15 which, in turn, drives a rack 16. Rack 16 is directly connected to a movable spring support member 17. Movable spring support member 17 carries a shaft 45 with rollers 43 and 44 which contact the underside of leaf spring 18. Leaf spring 18 is fixedly supported at end 19 by a stud 20 and a set screw 21. A roller 22 is mounted in end 23 of leaf spring 18. The underside of paper tray 24 rests on top of roller 22. Paper tray 24 is also pivotally mounted through ears 25 which are held by paper tray base 26.

Other elements of the paper bin assembly 10 include a preload spring 27 which is connected to the tray base 26 at one end, and to a preload arm 28 on the other end. Preload arm 28 is pivotally mounted together with a corner buckler arm 29. A corner buckler pointer 30 is mounted on the corner buckler arm 29. FIG. 2 also shows an adjustable paper stop 31, a tray cover 32, an adjustable paper guide 33, and a support plate 60 which covers the corner buckler arm 29 and preload arm 28 so that paper moves by them in an unimpeded fashion.

Figure 3:
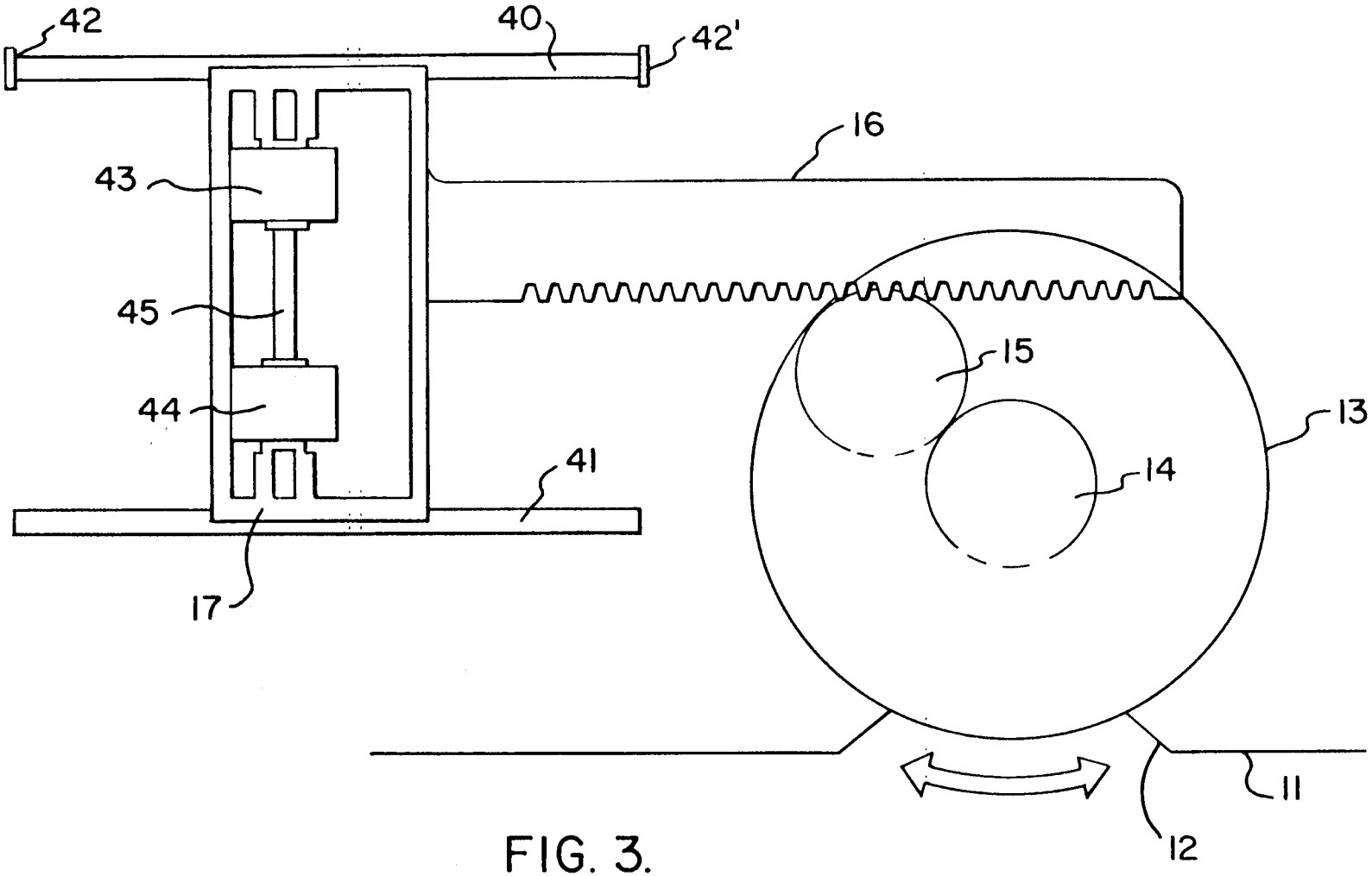
FIG. 3 is a schematic diagram of the manner in which the movable leaf spring support is caused to travel.

FIG. 3 shows the manner in which the leaf spring movable support member 17 is moved by the thumb wheel 13. A notch 12 is provided in the bottom cover 11 and in the paper tray base 26 (not shown in FIG. 3) so that the thumb wheel can be moved by the operator. As the thumb wheel moves, thumb wheel gear 14, which is fixedly connected on the thumb wheel shaft, is made to rotate. This, in turn, moves pinion gear 15 which causes the rack 16 to move in the desired direction. Rack 16 is fixedly connected to the truck of member 17 thereby causing the truck to slide along the tracks 40 and 41. Stop members 42' are positioned on the tracks such that the truck is caused to take a position between the stop members. Rollers 43 and 44 are mounted on shaft 45 and carried by the truck of the movable support member 17. Rollers 43 and 44 come into contact with the underside of leaf spring 18, as shown in FIG. 2. Thus, by rotation of the thumb wheel 13, the rollers 43 and 44 are caused to contact the leaf spring at different points on the underside thereof.

Figure 4:
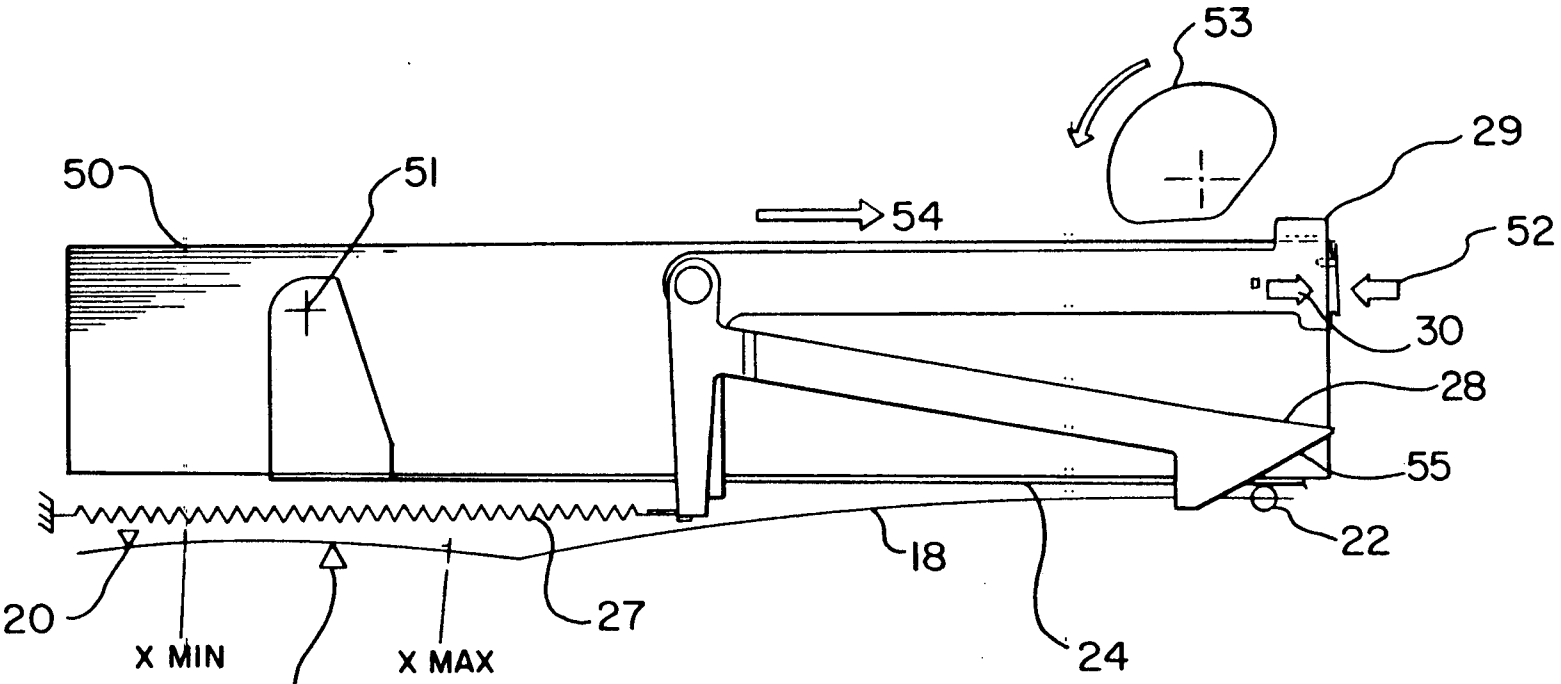
FIG. 4 is a schematic diagram of the paper feed mechanism of the instant invention.

FIG. 4 shows a schematic representation of the paper feed mechanism showing the leaf spring 18. The movable support member 17 is shown positioned some distance from the fixed support member stud 20. Roller 22 is positioned at the end of the leaf spring 18 to come into contact with, and support, the paper tray 24. The tray pivot point 51 also acts to support tray 24. A stack of paper 50 is shown positioned on the top surface of paper tray 24.

FIG. 4 shows the preload arm 28 and the corner buckler arm 29. The preload pointer 30 is shown in FIG. 4 together with a reference pointer 52 which is molded into the tray base 26. Feed roller 53 is shown positioned above the stack of paper 50 to feed sheets from the stack over the corner buckler in the feed direction 54. Note that the preload arm 28 is provided with an angled surface 55, which is a camming surface, to come into contact with a pin mounted in the machine in order to move the preload arm 28 upwardly when the assembly is inserted into the machine. The preload spring 27 is fastened to the preload arm 28 at one end, and to the paper tray base 26 at the other end.

In operation, for loading paper into the bin, the paper bin assembly 10 is slideably moved from the machine so that paper can be placed on the paper tray 24. The mechanism is designed so that the operator can adjust the spring rate of leaf spring 18 while the assembly is removed from the body of the machine. This is accomplished by rotating the thumb wheel 13 until the preload pointer 30 and the reference pointer 52 are in line with one another. Suppose, for example, that paper of a different size and/or density is loaded on the paper tray 24 relative to the paper used during the preceding load. In such a case, it will be necessary for the operator to make the thumb wheel spring rate adjustment. The mechanisms are designed such that movement of the thumb wheel will move the leaf spring support member 17, and thereby change the spring rate of leaf spring 18. This causes the leaf spring 18 to exert a different force on the underside of paper tray 24 thus causing the corner buckler to press against the top sheet of the paper with a variable force. When the arrows 30 and 52 are in line, the corner buckler is designed to provide about 0.5 pounds of force on the top sheet of the paper. When the paper bin assembly 10 is inserted into the machine, a pin bears against the camming surface 55 of the preload arm 28 to lift the corner buckler out of contact with the top sheet of the paper stack. However, the preload adjustment of the leaf spring ensures that as the feed roller 53 rotates to a feeding position, it will bear against the top sheet of the paper with approximately 0.5 pounds of normal force. Thus, the adjustment of the leaf spring movable support member 17, while the assembly 10 is out of operative position, enables the proper feed roll force when the assembly 10 is in operative position.

Figure 5:
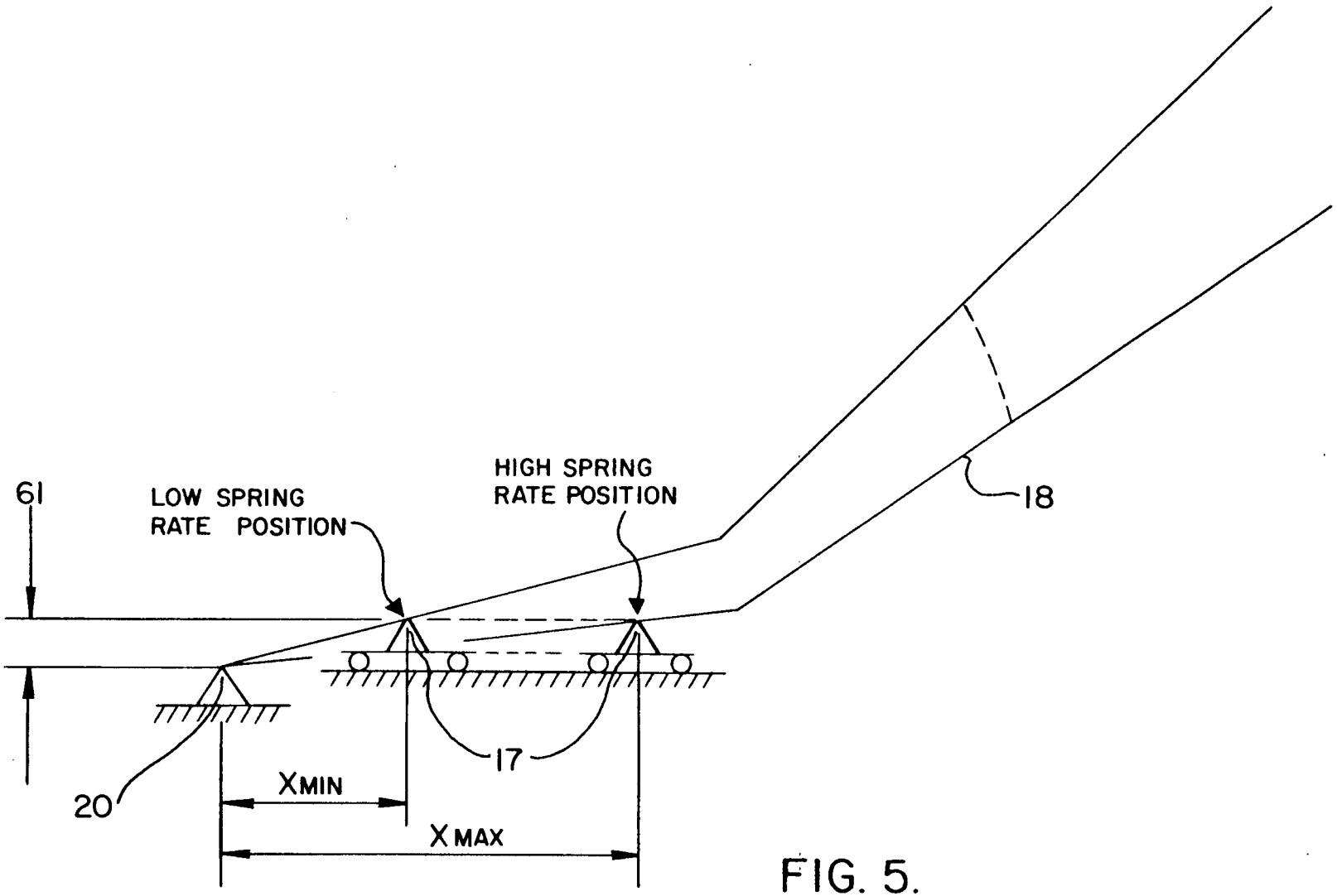
FIG. 5 is a schematic representation of the leaf spring arrangement of the instant invention.

FIG. 5 is a schematic representation of the leaf spring 18 and shows support member 17 at a first position, X minimum, and at a second position, X maximum. The spring rate of leaf spring 18 will vary from a high spring rate position at X maximum, to a low spring rate position at X minimum. As the spring rate varies, the amount of the deflection of the spring 18 also varies. That is, at the low spring rate position, the no-load deflection from the horizontal is greater than at the high spring rate position. FIG. 5 also shows that the support contact area of leaf spring 18, provided by the movable support member 17, is offset in a vertical direction relative to the support provided by the fixed support 20. This offset is shown at 61.

Figure 6:
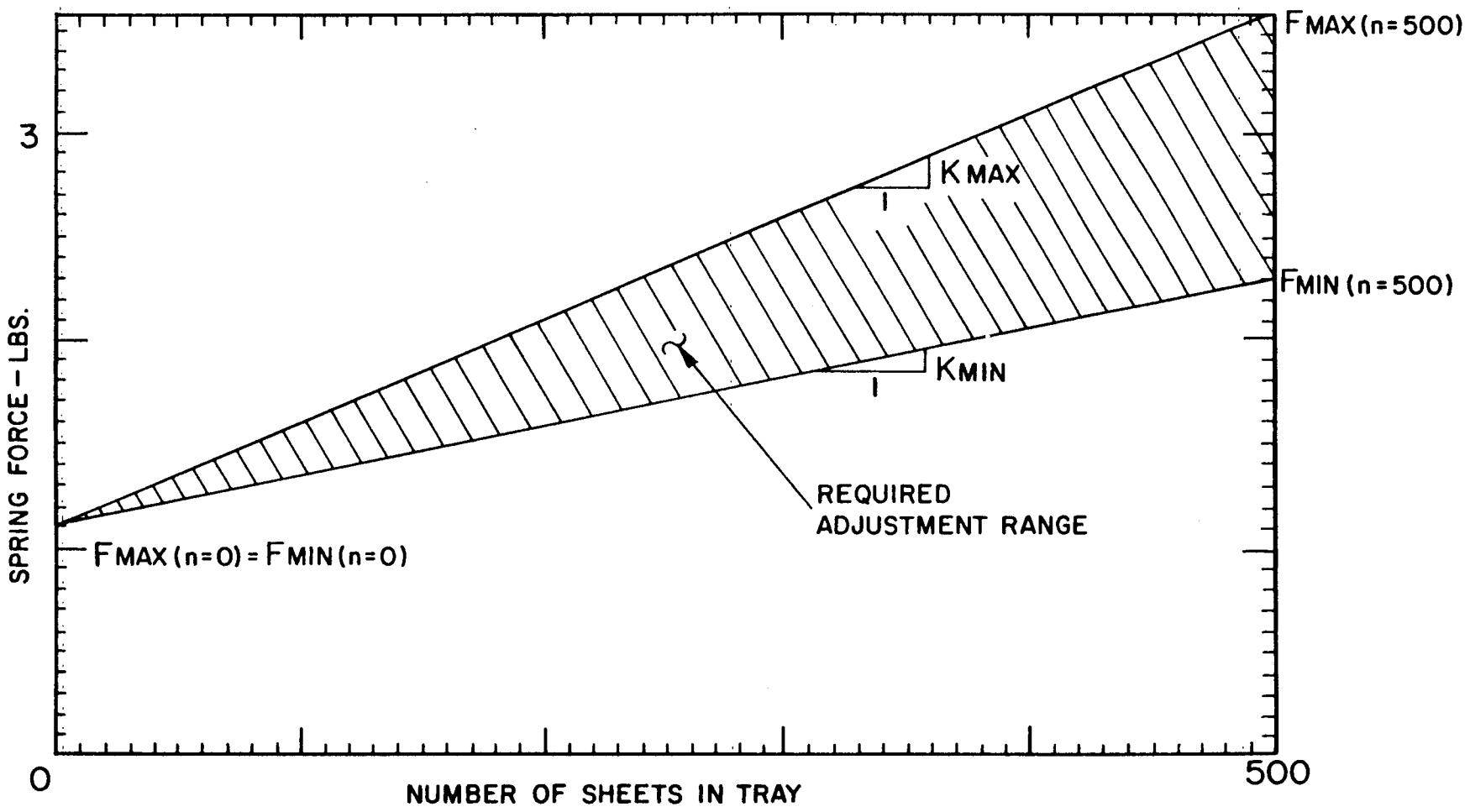
FIG. 6 is a graphical representation of the variation in spring force with the number of sheets contained in the paper tray.

FIG. 6 is a graphical representation of the variation in spring force with the number of sheets in the tray. One design objective is to provide the same spring force when there are no sheets in the tray regardless of the position of the movable support member 17. A second design objective is to provide a range of spring rate adjustment to accommodate a range of different size and densities of paper. Thus, if there are 500 sheets of heavy paper in the bin, the movable support member will be moved toward the high spring rate position i.e., toward a spring constant of K max, and will provide a maximum force on the underside of paper tray 24. If 500 sheets of low density small size paper are loaded in the bin, the movable support member 17 is moved toward the low spring rate position i.e., toward a spring constant of K min causing the force exerted by the leaf spring to be considerably lower. As the sheets are fed from the bin, regardless of whether they are heavy-weight paper or low-weight paper, it is desired to keep a constant normal force between the top sheet in the bin and the feed roll. That is accomplished by the instant invention since the spring force decreases as sheets of paper are fed from the bin in a manner that is related to the weight loss of paper as more and more sheets are fed out of the bin. Finally, at zero sheets of paper, the spring force is equal to that portion of the weight of the paper tray 24 carried by the spring (about 0.6 pounds in the preferred embodiment), together with the desired 0.5 pounds of normal force exerted by the feed roll 53 against the unloaded tray 24.

Figure 7:
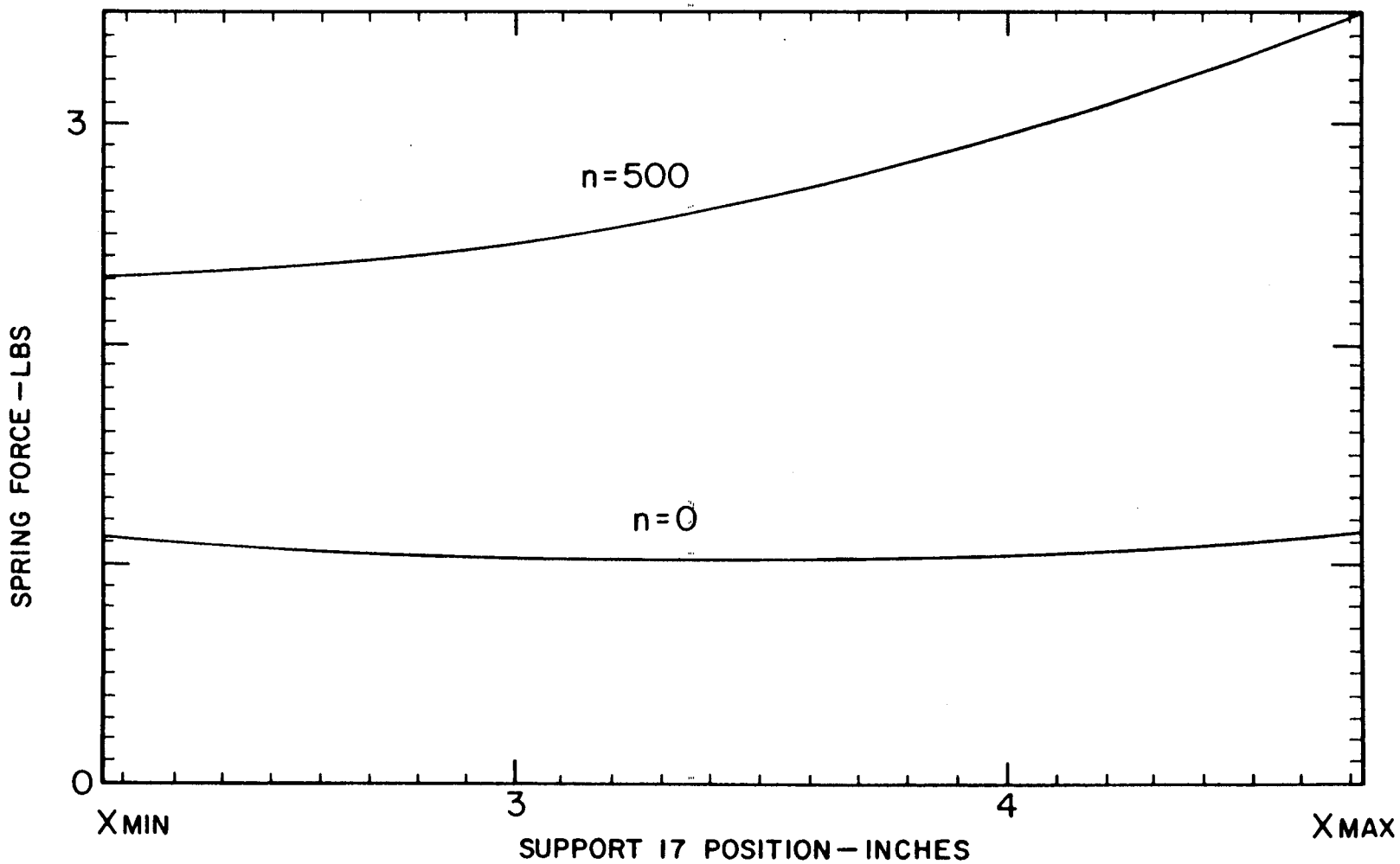
FIG. 7 is a graphical representation of the variation in spring force with variation in the position of the movable leaf spring support.

FIG. 7 shows the spring force exerted by leaf spring 18 over a range of positions of the movable support member 17 with the number of sheets in the bin equal to zero, and with the number of sheets equal to 500. It is a design objective to keep the spring force as linear as possible for the condition in which the number of sheets in the bin is equal to zero and thereby keep the desired 0.5 pounds force as the number of sheets approach zero, regardless of the position of member 17. When the number of sheets equals 500, the shape of the spring-force curve is not significant since the truck position is adjusted by the thumb wheel to get the desired 0.5 pounds of force for the particular size and density of paper in the bin.

The lift force the spring 18 must exert is defined by the following equation $$F(n)=m * n * Wp+Wt+Fc$$

where:

m is the portion of the paper weight carried by the spring n is the number of sheets Wp is the weight of a single sheet Wt is the portion of the metal support tray weight carried by the leaf spring Fc is the required contact force of the sheets against the feed roller Variables m, Wt and Fc are constant. The number of sheets vary from 500 to zero as the sheets are fed. The weight of a single sheet depends on the size and density of the paper. As previously noted, FIG. 6 shows how the force exerted by the spring 18 varies with the number of sheets in the tray. The spring rate must allow for an adjustment in spring force when the tray is fully loaded depending on the size and weight of the paper in the tray. Also, the spring force with zero sheets in the tray must be the same regardless of spring rate adjustment, and the spring force must vary linearly as the number of sheets decrease.

While the invention has been described with reference to a paper bin holding 500 sheets, and a desired normal force of 0.5 pounds between the feed roll and the paper, obviously the principals of this invention can be applied to a bin with a greater, or lesser, number of sheets of paper and a different normal force.

While the invention has been shown and described with reference to a particular embodiment thereof, it will be understood by those skilled in the art that changes in form and details may be made therein without departing from the spirit and scope of the invention.

What is claimed is:

1. A sheet holding mechanism for use in a processing machine, such as a copier or printer, comprising:

bin assembly means for holding a stack of print-receiving material;

a movable tray located within said bin assembly means for receiving said stack;

sheet feeding means for moving the top sheet from said stack into said machine;

leaf spring means located within said bin assembly means for applying a force to said movable tray to lift said tray to a position at which the top sheet on said tray is in a correct position for being fed into said machine by said sheet feeding means; and movable support means for said leaf spring means for moving in a first dimension to adjust the spring constant of said leaf spring means to provide a constant normal force between said top sheet and said sheet feeding means regardless of the size and density of sheets on said movable tray.

2. The sheet holding mechanism of claim 1 further including:

a fixed support means for said leaf spring means;

an offset in a second dimension between the contact areas with said leaf spring means of said fixed support means and said movable support means to provide a constant force on said tray under no-paper-load conditions regardless of the location of said movable support means.

3. The sheet holding mechanism of claim 1 further including a preload mechanism for enabling the machine operator to adjust the spring constant of said leaf spring means when said bin assembly means is removed from operative position within said machine.

4. The sheet holding mechanism of claim 3 wherein said preload mechanism includes:

a thumb wheel means whereby an operator can adjust said spring constant;

gear means operated by said thumb wheel means for moving said movable support means;

a movable preload arm;

a preload spring for biasing said preload arm in a clockwise direction;

a movable corner buckler arm on which a corner buckler is mounted for movement with said preload arm in said clockwise direction whereby said corner buckler is biased against the top sheet in said stack when said bin assembly means is removed from operative position within said machine;

a pointer mounted in said movable corner buckler arm; and a reference mark located on said bin assembly means whereby rotation of said thumb wheel enables the operator to move said pointer in line with said reference mark, thus enabling the adjustment of spring constant in accordance with the size and density of the paper load.

* * * * *